US008668469B2

(12) United States Patent
Fritz et al.

(10) Patent No.: US 8,668,469 B2
(45) Date of Patent: Mar. 11, 2014

(54) HYDRAULIC PISTON PUMP WITH REDUCED RESTRICTION BARREL PASSAGE

(75) Inventors: Wayne Fritz, Manhattan, IL (US); Jeremiah C. Johnson, Saint John, IN (US)

(73) Assignee: Caterpillar Inc., Peoria, IL (US)

( * ) Notice: Subject to any disclaimer, the term of this patent is extended or adjusted under 35 U.S.C. 154(b) by 241 days.

(21) Appl. No.: 13/096,624

(22) Filed: Apr. 28, 2011

(65) Prior Publication Data

US 2012/0275928 A1 Nov. 1, 2012

(51) Int. Cl.
*F04B 1/20* (2006.01)
*F01B 3/00* (2006.01)

(52) U.S. Cl.
USPC ..... 417/269; 92/71

(58) Field of Classification Search
USPC ..... 417/269; 92/71; 91/499
See application file for complete search history.

(56) References Cited

U.S. PATENT DOCUMENTS

| | | | | |
|---|---|---|---|---|
| 3,106,138 | A * | 10/1963 | Thoma | 92/156 |
| 4,350,079 | A | 9/1982 | Grahtmüller | |
| 4,920,856 | A | 5/1990 | Berthold et al. | |
| 5,554,007 | A | 9/1996 | Watts | |
| 6,237,465 | B1 * | 5/2001 | Forster et al. | 92/71 |
| 6,358,025 | B1 * | 3/2002 | Johansson | 417/499 |
| 6,406,271 | B1 * | 6/2002 | Valentin | 417/269 |
| 7,500,424 | B2 | 3/2009 | Gray, Jr. et al. | |
| 2004/0247454 | A1 * | 12/2004 | Donders | 417/269 |
| 2005/0226748 | A1 * | 10/2005 | Gray et al. | 417/440 |
| 2008/0138225 | A1 | 6/2008 | Shinohara et al. | |
| 2009/0013861 | A1 * | 1/2009 | Wanschura et al. | 91/504 |
| 2011/0030644 | A1 | 2/2011 | Rentschler et al. | |

FOREIGN PATENT DOCUMENTS

| | | | |
|---|---|---|---|
| DE | 102 33 582 | A1 | 7/2002 |
| JP | 06018670 | | 3/1994 |
| JP | 2008075568 | | 4/2008 |
| WO | WO-2009/124745 | A1 | 10/2009 |

OTHER PUBLICATIONS

Shin-Ici Kamimura; "*Introduction of Duplex Pump HPD71+71 and Short-Stroke Pump HPV112+112*"; magazine; 2003; pp. 46-51; vol. 49 No. 151.

* cited by examiner

*Primary Examiner* — Charles Freay
(74) *Attorney, Agent, or Firm* — Miller, Matthias & Hull

(57) ABSTRACT

The present disclosure sets forth an axial piston pump with greatly improved throughput. The axial piston pump provides cylinders, antechambers, and fluid flow apertures which are uniquely shaped and dimensioned so as to increase the overall flowability and expulsion rate of the piston pump. By providing curvilinear transition zones and fluid flow apertures, the cylinders can be completely filled and pressurized even at the extremely high pressures and RPMs required by modern machines. Such machines may include front-end loaders, excavators, pipe layers, graders, and the like wherein such pumps can be used to power hydraulic cylinders moving the implements, work arms and other tools associated with such machines.

17 Claims, 5 Drawing Sheets

HYDRAULIC PISTON PUMP WITH REDUCED RESTRICTION BARREL PASSAGE

FIELD OF DISCLOSURE

The present disclosure generally relates to hydraulics, and more particularly relates to hydraulic piston pumps.

BACKGROUND

Hydraulic fluid is used in a variety of machines to produce useful work. One prevalent example is with earth moving equipment such as front-end loaders, excavators, pipe layers, graders and the like. With such machines, hydraulic cylinders are provided and are operatively connected to various work arms or other implements and moved upon opening of valves directing hydraulic fluid to the cylinder. As the hydraulic fluid is incompressible, its introduction into the cylinder necessarily moves a rod telescopingly received within the cylinder and by connecting the rod to the implement or work arm, the implement or work arm are forced to move.

In order to provide the hydraulic fluid, one or more hydraulic pumps are typically provided on the machine and driven by the engine of the machine. Such pumps can be provided in a number of different forms, with axial piston pumps being one common example. With an axial hydraulic piston pump, a central barrel or block is rotatedly driven by the motor. The barrel includes a plurality of cylinders each of which is adapted to receive a reciprocating piston. At a driven end, each of the pistons is pivotally and slidably engaged with a swashplate angularly positioned relative to the cylinder barrel. At a work end of each cylinder, a valve plate is provided having two or more kidney-shaped inlets and outlets. During the inlet phase of operation, hydraulic fluid is drawn in through the inlet of the valve plate, and into the cylinders of the rotating barrel. This drawing in or filling of the cylinders occurs as the barrel rotates, and the pistons of the barrel proximate to the inlet move from a top dead center position to bottom dead center position. The rotation of the barrel and size of the inlets are such that once the piston reaches its bottom dead center position, the cylinders rotate out of communication with the inlet of the valve plate. Further rotation of the barrel causes the cylinders, now completely filled with hydraulic fluid, to create fluid flow as the pistons move from the bottom dead center position to the top dead center position. During travel from the bottom dead center to the top dead center position, the cylinders are placed into communication with the outlet of the valve plate such that the hydraulic fluid can be delivered from the pump to provide for useful work such as the aforementioned driving of implements and work arms provided on various earth moving equipment.

While effective, and used in industry for decades, hydraulic piston pumps are not without drawbacks. As requirements placed on such work machines are steadily increased, the speed with which the hydraulic piston pumps deliver the fluid is constantly in need of improvement. Moreover, the pressures required so as to perform necessary work are also being steadily increased. However, if the speed and pressures at which the hydraulic fluid is to be delivered are constantly increased, it is important that the cylinders be filled as quickly as possible, the fluid flow be generated as quickly as possible, and the fluid be fully exhausted from the cylinders as quickly as possible. Not only must the cylinders be filled, but they should be completely filled as any voids in the cylinder or air pockets will necessarily cause cavitation in the operation of the pump and low pump efficiencies. Such cavitation results in significant vibrations affecting pump life and performance and are to be avoided. The extremely high pressures under which the pumps are operated, also require sufficient structural rigidity within the components of the pump so as to withstand such pressures.

One example of an axial piston pump is set forth in U.S. Pat. No. 5,554,007 assigned to the present assignee. While effective, such a design does not allow for the high speeds and pressures currently being sought.

SUMMARY OF THE DISCLOSURE

In accordance with one aspect of the disclosure, a hydraulic piston pump is disclosed which may comprise a rotating barrel, a plurality of cylinders provided within a rotating barrel with each cylinder having a cylinder wall, a reciprocating piston provided within each cylinder, and a fluid flow aperture provided at one end of each cylinder, each fluid flow aperture being defined by surfaces provided at compound angles.

In accordance with another aspect of the disclosure, a method of increasing throughput of a hydraulic piston pump is disclosed which may comprise rotating a barrel having a plurality of cylinders therein, each cylinder having a fluid flow aperture, reciprocating a piston within each cylinder, each piston including a driven end slidable against a swashplate, and a working end proximate to the fluid flow aperture, drawing fluid into the cylinder through the fluid flow aperture as the piston working end moves away from the fluid flow aperture, compressing the fluid after the piston reaches a bottom dead center position within the cylinder, and pushing the compressed fluid through a fluid flow aperture as the piston working end moves toward the top dead center position, wherein the drawing and pushing steps cause the fluid to move through the fluid flow apertures along a fluid path directed at a transverse angle relative to a longitudinal axis of the cylinders.

In accordance with another aspect to the disclosure, a hydraulic piston pump is disclosed which may comprise a rotating barrel, a plurality of cylinders provided within the rotating barrel, each cylinder having a cylinder wall and a longitudinal axis, a reciprocating piston provided within each cylinder, a swashplate provided at a transverse angle relative to the longitudinal axis and positioned at the first end of the rotating barrel, a valve plate provided at a second end of the rotating barrel, and a fluid flow aperture provided between each cylinder and the valve plate, each fluid flow aperture being transversely angled relative to the longitudinal axis.

These and other aspects and features of the disclosure will become more readily apparent upon reading the following detailed description when taking in conjunction with the accompanied drawings.

While the present disclosure is susceptible to various modifications and alternative constructions, certain illustrative embodiments thereof, will be shown and described below in detail. It should be understood, however, that there is no intention to be limited to the specific embodiments disclosed, but on the contrary, the intention is to cover all modifications, alternative constructions, and equivalents along within the spirit and scope of the present disclosure.

DETAILED DESCRIPTION

Figure 1:
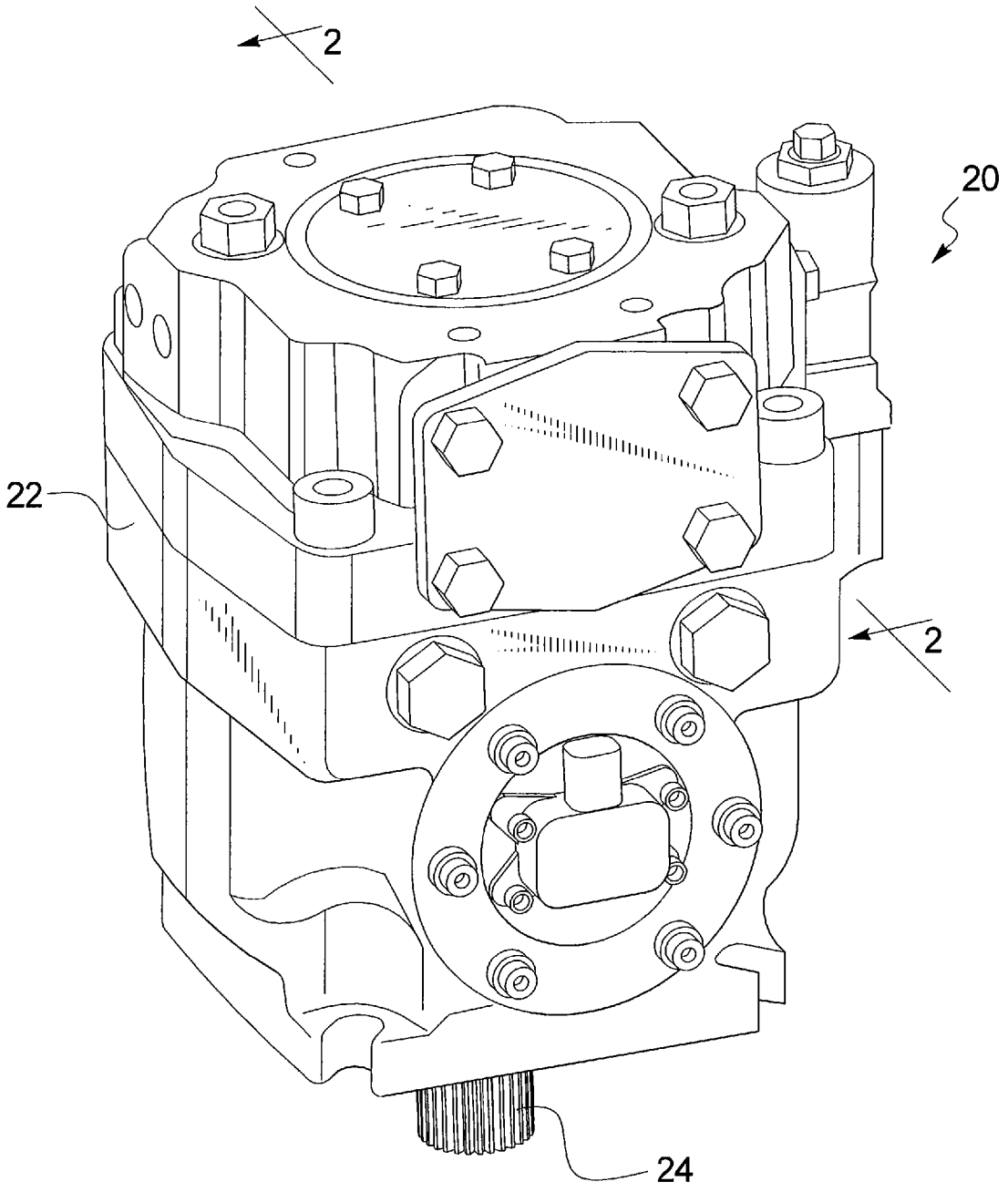
FIG. 1 is a perspective view of an axial piston pump constructed in accordance with the teachings of the disclosure.

Referring now to the drawings, with specific reference to FIG. 1, an axial piston pump constructed in accordance with the teachings of the disclosure is generally referred to by reference numeral 20. As shown therein, the pump 20 includes an exterior housing 22 from which extends a drive shaft 24 for connection to a transmission and engine of a larger machine on which the pump is positioned. The pump 20 is designed to draw hydraulic fluid in through inlet 26 (See FIG. 2) and expel hydraulic fluid out through outlet 28 (See FIG. 2) for communication to implements or work arms of the machine (not shown).

Figure 2:
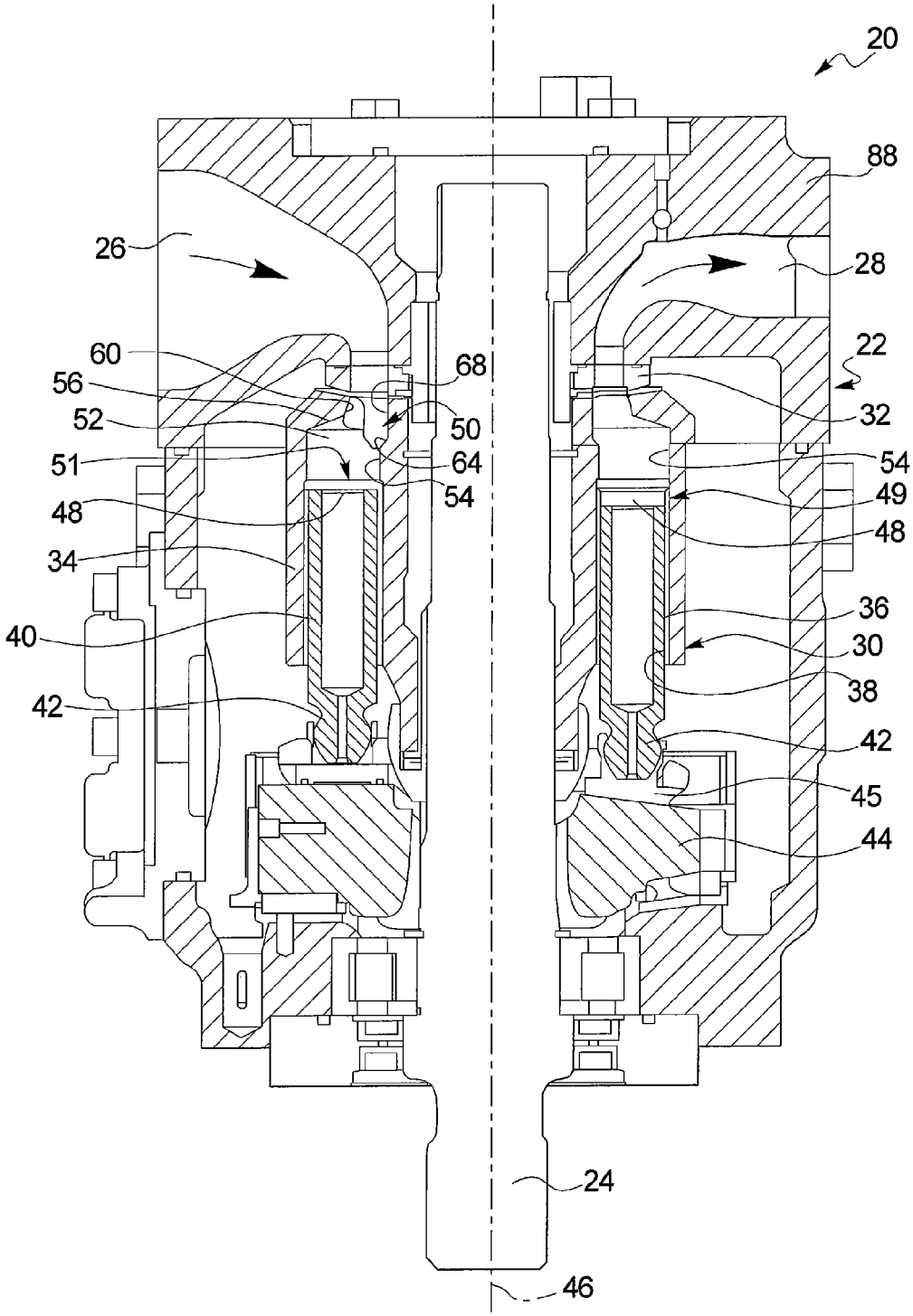
FIG. 2 is a longitudinal cross-sectional view of the pump taken along line 2-2 of FIG. 1.

With reference to FIG. 2, a cross-sectional view of the pump 20, taken along lines 2-2 of FIG. 1 is shown. It can be seen that the drive shaft 24 is operatively connected to a barrel 30 adapted to rotate within the housing 22. The barrel 30 is positioned next to a valve plate 32 which itself is in fluid communication with the aforementioned inlet 26 and outlet 28.

Figure 3:
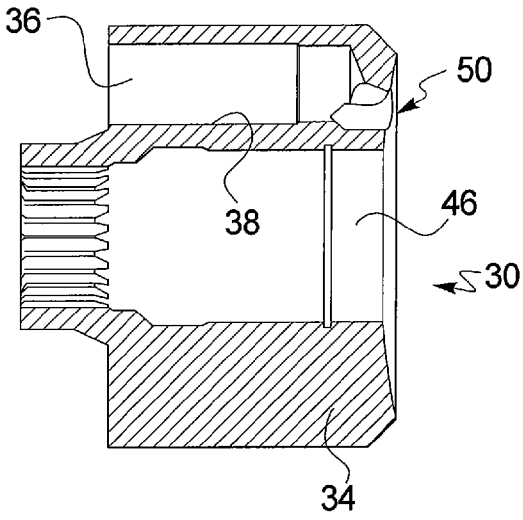
FIG. 3 is a longitudinal sectional view of a cylinder barrel constructed in accordance with the teachings of the disclosure.
Figure 4:
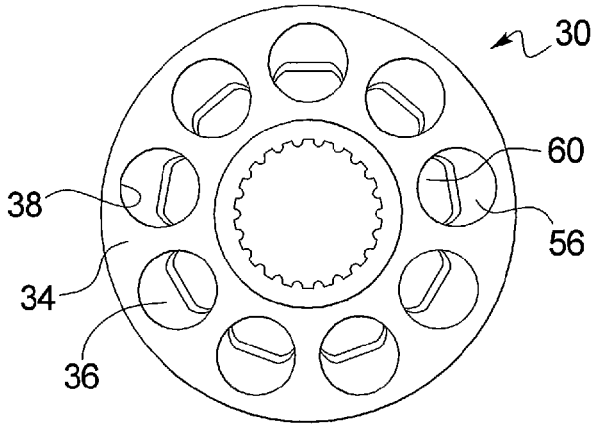
FIG. 4 is a bottom view of the cylinder barrel of FIG. 3.
Figure 5:
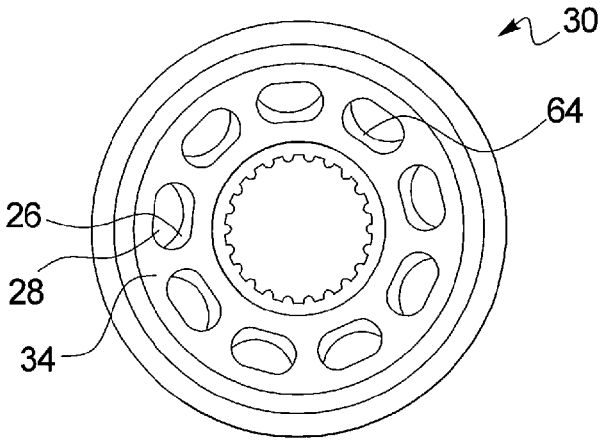
FIG. 5 is a top view of the cylinder barrel of FIG. 3.

With reference also to FIGS. 3-5, the barrel 30 is shown in further detail. The barrel 30 may include a block 34 in which are machined a plurality of cylinders 36. Each cylinder 36 is parallel and includes a cylinder wall 38. As shown best in FIG. 2, a piston 40 is reciprocatingly mounted within each of the cylinders 36. More specifically, each piston 40 is adapted to reciprocate within the cylinders 36 as the pistons 40 and cylinder barrel 30 rotate around the pump 20 through inlet and outlet strokes.

In order to reciprocate the pistons 40 through the cylinders 36, a driven end 42 of each piston is rotatably and slideably engaged with a swashplate 44 by way of a shoe 45. As will be noted, the swashplate 44 can be provided at a transverse angle relative to the cylinder barrel 30 such as that as the barrel 30 and pistons 40 rotate about longitudinal axis 46 under the influence of hydraulic fluid entering and exiting the cylinders 36, the pistons 40 are caused to reciprocate back and forth therein. Moreover, the angle at which the swashplate 44 is positioned necessarily dictates the resulting volume of fluid flow from the pump 20. For example, if the swashplate 44 is parallel to the valve plate 32, then there would be no flow of fluid at all. However, with each degree the swashplate 44 is pivoted away from parallel, the resulting flow of the expelled fluid is increased.

Opposite to the driven end 42, each piston 40 includes a working end 48. Also shown in FIG. 2, the working end 48 is adapted to reciprocate between a bottom dead center position 49, and a top dead center position 51. As one of the ordinary skill in the art will understand, during the filling or intake stroke of each piston 40, the working end 48 moves from the top dead center position 51 to the bottom dead center position 49; and during the exhaust stroke, the working end 48 moves from a bottom dead center position 49 to the top dead center position 51.

The hydraulic fluid drawn in during the intake stroke and expelled during the exhaust stroke is navigated through a plurality of fluid flow apertures 50 shown in FIGS. 2-6. As shown therein, each is substantially oval in lateral cross-sectional shape, but includes a plurality of facets and angles to facilitate inflow and outflow and thus overall throughput of the pump 20, as will now be described.

Figure 6:
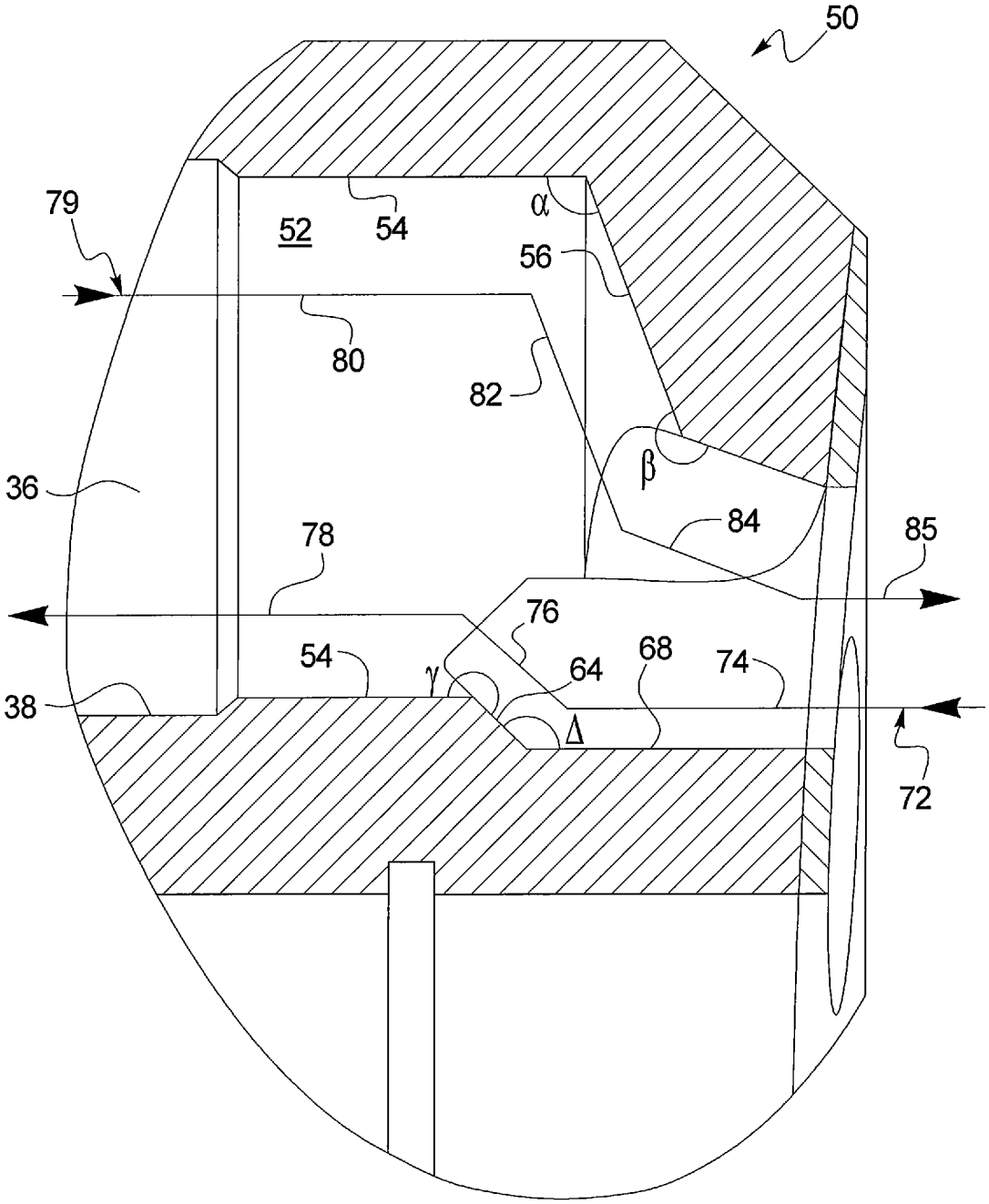
FIG. 6 is enlarged sectional view of a fluid flow aperture provided in the cylinder barrel and constructed in accordance with the teachings of the disclosure.

Perhaps best shown in FIG. 6, each of the fluid flow apertures 50 includes a plurality of surfaces angled at specific dimensions and degrees so as to most effectively fill and exhaust the hydraulic fluid. For example, each cylinder 36 may terminate in an antechamber 52 having an antechamber wall 54 concentric with the cylinder wall 38, but with a slightly smaller diameter. The antechamber 54 wall leads to a first output engagement wall 56 provided at a transverse angle relative to the antechamber wall 54. While not wishing to be bound to any particular theory, the inventors have found that angling the first output engagement wall 56 relative to the antechamber wall 54 (or cylinder wall 38) at an angle $\alpha$ of about 115° facilitates flow of the hydraulic fluid through the pump 20. In other embodiments, the angle $\alpha$ can be provided within a range of about 100° to about 130°.

The first output engagement wall 56 then extends into a second output engagement wall 60 provided in angle $\beta$ relative to the first output engagement wall 56. Again, while not wishing to be bound to any particularly theory, the angle $\beta$ can be provided at an angle of about 140° relative to the first engagement wall with a range of approximately 125° to 155° being possible. Moreover, as will be seen in FIGS. 4-5, the first and second output engagement walls 56 and 60, respectively, are not planar in shape, but rather curved in accordance with the overall kidney shape (specifically a compound kidney shape) of the fluid flow apertures 50.

Referring again to FIG. 6, the fluid flow apertures 50 are further defined by a first input engagement wall 64 provided at a transverse angle relative to the antechamber wall 54. In the depicted embodiment, the first input engagement wall 64 is provided in an angle $\gamma$ of approximately 130° relative to the antechamber wall 54 with a range of approximately 115° to 145° being suitable. The first input engagement wall 64 transitions into a second input engagement wall 68 provided in an angle $\Delta$ of approximately 130° relative to the first input engagement wall. Accordingly, it will be noted that the second input engagement wall 68 is substantially parallel to the antechamber wall 54. Moreover, as will be noted from FIG. 5, the first input engagement wall 64 is curved in a manner similar to the second output engagement wall 60 to form a compound kidney shape.

In doing so, it can be seen that the cylinder 36, antechamber 52 and fluid flow apertures 50 cooperate to define an inlet fluid flow path 72 which is not linear in direction, but curvilinear having multiple angular sections. In operation, during an input stroke of the piston 40, the fluid flow path begins in a section 74 wherein hydraulic fluid is drawn through the fluid flow aperture 50 in a direction parallel to the longitudinal axis 46 but laterally offset from the cylinders 36. This section 74 continues along the second input engagement wall 68 until reaching the first engagement input wall 64, wherein in the fluid flow path 72 is directed radially outwardly in a section 76. This motion continues until the fluid flow path 72 reaches a third section 78 defined by the antechamber 52, whereupon the fluid then enters the cylinder 36. During an output stroke, a fluid flow path 79 is created wherein the compressed fluid is moved through the cylinder 36 until reaching the antechamber 52. The antechamber 52 defines a section 80 wherein the compressed fluid moves in a manner parallel to and concentric with the cylinder 36. The compressed fluid then engages the first output engagement wall 56 where it is directed radially inwardly through a section 82 until reaching a section 84, where it is then redirected by the second output engagement wall 60. In cooperation with the second input engagement wall 68, the fluid thus exits the cylinder block 34 along section 85.

Figure 7:
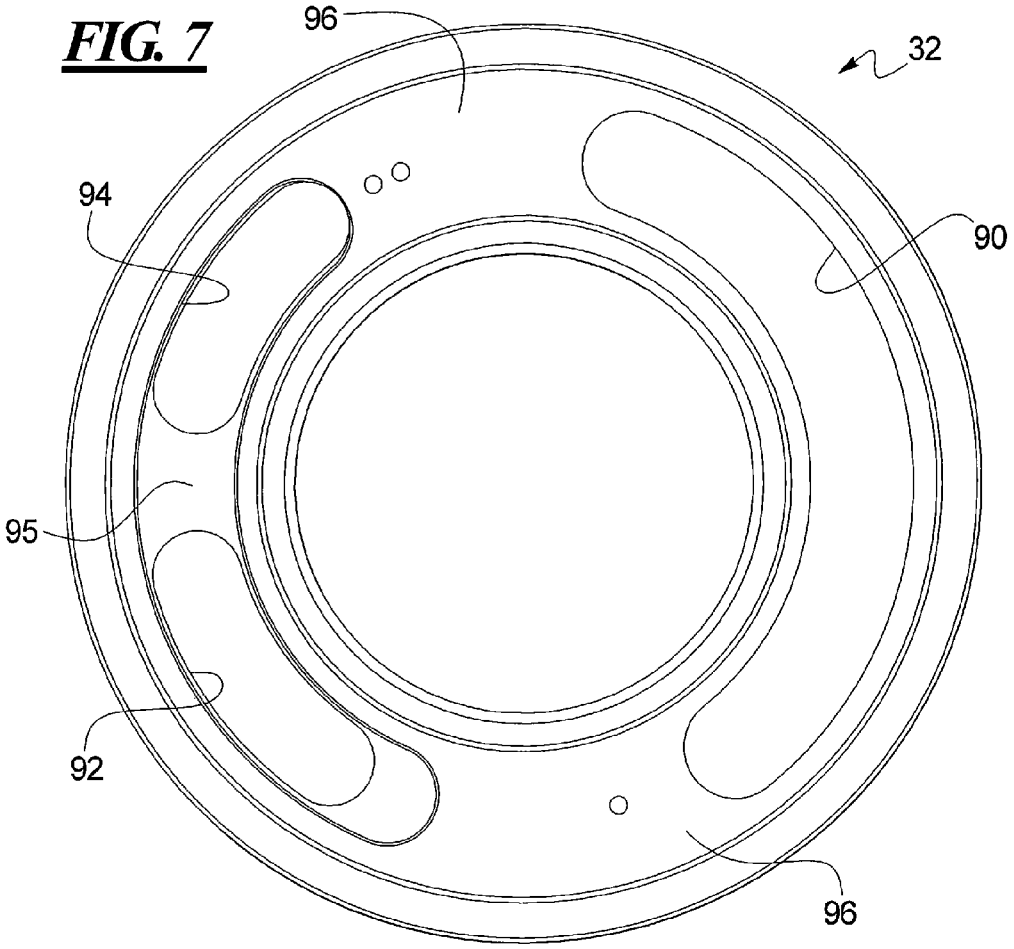
FIG. 7 is a top view of a valve plate constructed in accordance with the teachings of the disclosure.
Figure 8:
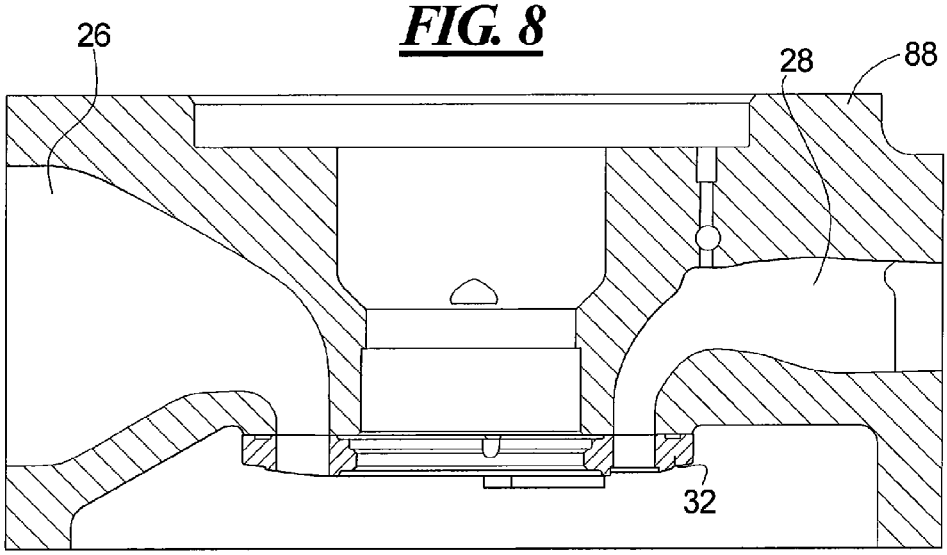
FIG. 8 is a cross-sectional view of a port block and the valve plate of FIG. 7.

Referring now to FIGS. 7 and 8, it will be noted that the fluid flow apertures 50 cooperate with the valve plate 32 and port block 88 to draw the hydraulic fluid in through inlet 26, and direct hydraulic fluid out through to the outlet 28. The valve plate 32 does so by providing inlet aperture 90 and first and second outlet apertures 92 and 94, respectively. As will be noted best from FIG. 7, each of the inlet and outlet apertures 90-94 have a curvilinear or kidney shape to facilitate communication of the hydraulic fluid as the cylinder block 34 and the cylinders 36 rotate relative to the valve plate 32. More specifically, since the valve plate 32 is fixed within the pump 20 while the barrel 30 rotates, by providing the valve plate 32 with the kidney shaped inlet and outlet apertures 90-94, the communication of the fluid can be accomplished during such rotation.

With specific reference to the inlet aperture 90, it will be seen to traverse more than 90° around the valve plate 32 but less than 180°. The outlet apertures 92 and 94 on the other hand each traverse less than 90° around the valve plate 32. This is done to provide clear transitions between the inlet 26 and the outlet 28 and between the suction and compression strokes. Again, as indicated above, during the inlet stroke, the piston 40 reciprocates through the cylinders 36 away from the valve plate 32 from the top dead center position 51 to the bottom dead center position 49. Upon reaching the bottom dead center position 49, the cylinder 36 is completely filled with hydraulic fluid and thus it is necessary to cease fluid communication from the supply of hydraulic fluid and to continue to rotate the filled cylinder 36 toward the outlet apertures 92 and 94. However, before doing so, transition zones 96 of the valve plate 32 maintain the disconnection of the fluid flow, thus allowing the piston 40 to reverse direction and to begin compressing the fluid as the piston 40 moves from the bottom dead center position 49 to the top dead center position 51. Upon rotating through the first outlet aperture 92 and the second outlet aperture 94, the fluid due to the change in displacement within the cylinder 36 is expelled and the piston 40 approaches the top dead center position 51 again.

Each compound kidney shaped inlet and outlet in the barrel 30 may be created by first machining a kidney shape at an angular axis to a barrel axis. Then a second slightly larger kidney shape may be machined parallel to the barrel axis. By virtue of machining the slightly larger second kidney shape, a very accurate kidney shape when matched to the valve plate 32 may be achieved. Compound kidney shapes machined in this manner have lower pressure drops due to a less restricted shape. A less restricted shape may also be achieved by angling the flow to the cylinders 36 by immediately increasing the smallest area at the valve plate 32 during inlet flow towards the cylinders through the inlet aperture 90. This allows good (complete) fill of the hydraulic fluid within the cylinders 36 at higher speed capabilities. Complete inlet fill prevents cavitation and improves volumetric efficiencies.

In prior art axial piston pumps, the actuation bore may be provided as a continuous and constant kidney shaped opening. However, given the relatively high pressures under which the present pump 20 is designed to operate, the outlet aperture of the present disclosure is provided as first and second outlet apertures 92 and 94. Among other things, this provides for added structural rigidity in the form of bridge 95 to withstand such high pressures. For example, while not wishing be bound by any particular theory, the pump 20 is adapted to operate under pressures in excessive 40 MPa, (~5802 psi) and speeds of 1,000 RPMs.

Thus, the present disclosure dramatically improves upon the fluid dynamics of conventionally hydraulic piston pumps and achieves an approximately 5% percent increase in throughput over conventional hydraulic piston pumps by providing the uniquely shaped and dimensioned fluid flow apertures indicated above.

INDUSTRIAL APPLICABILITY

In general, the present disclosure sets forth an axial piston pump with greatly improved throughput. The axial piston pump provides cylinders, antechambers, and fluid flow apertures which are uniquely shaped and dimensioned so as to increase the overall input flowability which allows higher operating speeds resulting in a higher expulsion rate for a given pump size. By providing curvilinear transition zones and fluid flow apertures, the cylinders can be completely filled and pressurized even at the extremely high pressures and RPMs required by modern machines. Such machines may include, but are not limited to, front-end loaders, excavators, pipe layers, graders, and the like wherein such pumps can be used to power hydraulic cylinders to move implements, work arms, and other tools associated with such machines.

What is claimed is:

1. A hydraulic piston pump, comprising:

a rotating barrel;

a plurality of cylinders provided within the rotating barrel, each cylinder having a cylinder wall;

a reciprocating piston provided within each cylinder; and a fluid flow aperture provided at an end of each cylinder, each fluid flow aperture being defined by surfaces provided at compound angles;

wherein the fluid flow apertures are defined by a first and second output engagement walls, and first and second input engagement walls;

wherein the first and second output engagement walls and first and second input engagement walls are all provided at different angles relative to the cylinder walls;

wherein the second input engagement wall is provided parallel to the cylinder wall.

2. The hydraulic piston pump of claim 1, wherein the first output engagement wall is provided at an angle of about 100°-130° relative to the cylinder wall.

3. The hydraulic piston pump of claim 2, wherein the first output engagement wall is provided at an angle of about 115° relative to the cylinder wall.

4. The hydraulic piston pump of claim 2, wherein the second output engagement wall is provided at an angle of about 125°-155° relative to the first output engagement wall.

5. The hydraulic piston pump of claim 4, wherein the second output engagement wall is provided at an angle of about 140° relative to the first output engagement wall.

6. The hydraulic piston pump of claim 4, wherein the first input engagement wall is provided at an angle of about 115°-145° relative to the cylinder wall.

7. The hydraulic piston pump of claim 6, wherein the first input engagement wall is provided at an angle of about 130° relative to the cylinder wall.

8. The hydraulic position pump of claim 1, wherein the first input engagement wall is non-planar.

9. The hydraulic piston pump of claim 1, wherein the second output engagement wall is non-planar.

10. The hydraulic piston pump of claim 1, wherein the fluid flow apertures are substantially oval-shaped in lateral cross-section.

11. The hydraulic piston pump of claim 1, further including an antechamber between each cylinder and the fluid flow apertures defined by the first and second output engagement walls and the first and second input engagement walls.

12. A method of increasing throughput of a hydraulic piston pump, comprising:

rotating a barrel having a plurality of cylinders therein, each cylinder having a cylinder wall and a fluid flow aperture;

reciprocating a piston within each cylinder, each piston including a driven end sliding against a swashplate, and a working end proximate the fluid flow aperture;

drawing fluid into the cylinder through the fluid flow aperture as the piston working end moves away from the fluid flow aperture;

pressurizing the fluid after the piston reaches a bottom dead center position within the cylinder; and pushing the pressurized fluid through the fluid flow aperture as the piston working end moves toward a top dead center position;

wherein the drawing and pushing steps cause the fluid to move through the fluid flow aperture along a fluid flow path directed at a transverse angle relative to a longitudinal axis of the cylinders;

wherein the fluid flow apertures are defined by a first and second output engagement walls, and first and second input engagement walls;

wherein the first and second output engagement walls and first and second input engagement walls are all provided at different angles relative to the cylinder walls;

wherein the second input engagement wall is provided parallel to the cylinder wall.

13. The method of claim 12, wherein the fluid flow path involves at least two sections, each section being directionally defined relative to the other and relative to the longitudinal axis of the cylinder.

14. A hydraulic piston pump, comprising:

a rotating barrel;

a plurality of cylinders provided within the rotating barrel, each cylinder having a cylinder wall and a longitudinal axis;

a reciprocating piston provided within each cylinder;

a swashplate provided at a transverse angle relative to the longitudinal axis and positioned at a first end of the rotating barrel;

a valve plate provided at a second end of the rotating barrel; and a fluid flow aperture provided between each cylinder and the valve plate, each fluid flow aperture being transversely angled relative to the longitudinal axis;

wherein the fluid flow apertures are defined by a first and second output engagement walls, and first and second input engagement walls;

wherein the first and second output engagement walls and first and second input engagement walls are all provided at different angles relative to the cylinder walls;

wherein the second input engagement wall is provided parallel to the cylinder wall.

15. The hydraulic piston pump of claim 14, wherein each fluid flow aperture is formed by surfaces provided at compound angles.

16. The hydraulic piston pump of claim 15, wherein each fluid flow aperture is formed by at least four distinct surfaces, none of the four distinct surfaces being parallel.

17. The hydraulic piston pump of claim 14, wherein the valve plate includes one kidney-shaped inlet aperture, and two kidney-shaped outlet apertures, the one kidney-shaped inlet aperture being separated from each of the two kidney-shaped outlet apertures by a transition zone and the two kidney-shaped outlet apertures being separated from one another by a bridge.

* * * * *